United States Patent [19]

Ogletree

[11] 4,371,395

[45] Feb. 1, 1983

[54] TECHNIQUE FOR ADDING LEAD TO STEEL

[75] Inventor: Robert H. Ogletree, Carrollton, Ga.

[73] Assignee: Southwire Company, Carrollton, Ga.

[21] Appl. No.: 280,717

[22] Filed: Jul. 6, 1981

[51] Int. Cl.[3] ..... C21B 7/02

[52] U.S. Cl. ..... 75/129; 75/53; 75/58

[58] Field of Search ..... 75/53, 58, 129

[56] References Cited

U.S. PATENT DOCUMENTS

| | | | |
|---|---|---|---|
| 2,781,258 | 2/1957 | Niedzwiedzki | 75/123 F |
| 3,671,224 | 6/1972 | North | 75/123 F |
| 3,726,669 | 4/1973 | Breyer | 75/129 |
| 3,756,805 | 9/1973 | Ormaechea | 75/129 |
| 3,820,982 | 6/1974 | Thomas | 75/129 |
| 3,836,359 | 9/1974 | Thomas | 75/129 |
| 3,876,422 | 4/1975 | Cantera | 75/129 |
| 4,056,387 | 11/1977 | Cantera | 75/129 |
| 4,203,763 | 5/1980 | Johnsson | 75/129 |

*Primary Examiner*—P. D. Rosenberg

*Attorney, Agent, or Firm*—Herbert M. Hanegan; Stanley L. Tate; Terrence Martin

[57] ABSTRACT

A resulfurized ferrous alloy including lead characterized in that the lead is well dispersed in the steel matrix and the free lead globules are controlled as to size, is produced by introducing the lead into a steel melt in the form of a fine lead sulfide (PbS), or galena powder. The alloy produced exhibits improved machinability, which characteristic is further enhanced by the formation of manganese sulfide particles which are well distributed and have minimum aspect ratio (i.e., are round) when the melt has been deoxidized with manganese.

15 Claims, 1 Drawing Figure

TECHNIQUE FOR ADDING LEAD TO STEEL

TECHNICAL FIELD

The present invention relates to leaded, resulfurized steel alloys exhibiting improved machinability characteristics, such as longer cutting tool life, faster cutting and thus metal shaping and metal removal, often with reduced cutting effort.

BACKGROUND ART

Carbon steel bars having good machinability may be produced by the addition of certain elements, commonly phosphorous, lead, sulfur, or certain rare earth elements, either singly or in combination. The present invention relates to the addition of certain of these elements in the powdered form of a naturally occurring compound.

In the known method of adding lead to steel, a stream of high-purity, closely sized (−20, +40 mesh) lead shot is introduced by means of an air-blast gun into the stream of molten steel as it is being teemed from ladle to mold. The pressure of the gun is carefully controlled so that the rate of addition is proportional to the teeming rate. Extreme care is required to minimize lead segregation. Because lead has only limited solubility in molten steel, because of the greater density of lead, and because of the lower solidus temperature of lead, significant lead segregation frequently occurs—especially at the bottom of the ingot molds in conventional casting.

In conventional casting, a portion of the bottom of the ingot is cut off and discarded; a test portion of the remaining ingot bottom is then removed and given a sweat test for exudation of lead as determined by visual inspection. Further sections may be removed until the sweat test indicates acceptable segregation levels. The lead is generally conceded to be present in elemental form as small inclusions, though previously it was believed to exist as a submicroscopic dispersion. The lead inclusions usually accompany manganese-sulfide inclusions in manganese deoxidized, resulfurized and leaded steels.

It is believed that the lead inclusions improve free-machinability due to softness and an internal lubricity effect. The optimum shape for the lead and/or manganese sulfide inclusions is believed to be round, or stated differently, as having a minimal aspect ratio. Free machinability is believed associated with this minimum aspect ratio and with well dispersed inclusions.

Silicon and aluminum are to be minimized or avoided, as manganese silicate inclusions impair machinability because they are abrasive, have an undesirable stringer morphology, and surround the manganese sulfide inclusions, thus reducing their effectiveness. Abrasive inclusions such as alumina, produced by aluminum deoxidation practices, produce rapid wear of cutting tools and are thus also to be avoided.

DISCLOSURE OF INVENTION

With the foregoing in mind the method of adding lead in the form of lead sulfide according to the present invention was developed. Lead sulfide, PbS, is a naturally occurring mineral found as galena. Galena ores may also contain ZnS, $FeS_2$, $FeCO_3$, and $SiO_2$, although pure galena is composed of 86.6 weight percent lead and 13.4 weight percent sulfur; it has a molecular weight of 239.26. Widely distributed throughout the world, galena is found in usually cubic crystalline form having a highly perfect cubic cleavage, lending itself to ready crushing and easy pulverization into a fine powder. Lead used in leaded steels is oridinarily derived from roasting galena, which has a melting point of 2037° F., as compared to 618° F. for lead and 2795° F. for iron. In addition to a more similar melting temperature, lead sulfide has a specific gravity (7.5) which is much closer to iron (7.87) than lead (11.34).

This invention, therefore, contemplates the addition of lead to a manganese deoxidized steel melt in the form of a fine lead sulfide powder to produce the desirable properties of an improved free-machining leaded steel having a more homogeneous dispersion of the lead in the steel matrix and well-distributed, minimum aspect ratio (i.e. round) manganese sulfide particles than by prior art methods.

Previous methods of preparing leaded steels containing sulfur have resulted in hot-shortness, which is avoided in the present invention, substantial lead segregation, and a severe health hazard due to exposure of operating personnel to lead in the form of shot, particulates and especially lead fumes.

An object of this invention is therefore a new and improved method of adding lead to steel to produce a steel product wherein the inclusions associated with free machinability are well distributed, small in size and present a minimal aspect ratio (are globular in form).

Another object of this invention is reducing hot-shortness previously associated with the presence of sulfur in casting steel.

Yet another object is the reduction of lead originated health hazards to casting operators.

With these and other objects in view which may become hereinafter apparent, the nature of the invention may be more clearly understood by reference to the drawing FIGURE forming a part hereof and the examples included in the description of the preferred embodiment.

BRIEF DESCRIPTION OF THE DRAWING

Other features and advantages of the invention disclosed herein will be apparent upon examination of the drawing FIGURE forming a part hereof, in which apparatus is shown for injecting powdered lead sulfide into the casting mold of a conventional reciprocating mold continuous casting machine.

BEST MODE FOR CARRYING OUT THE INVENTION

Figure 1:
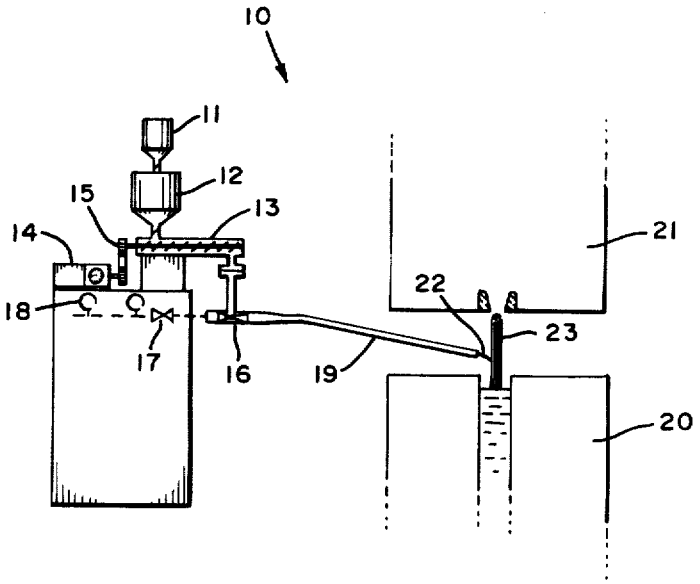

The present invention contemplates the addition of powdered lead sulfide, PbS or galena, into a casting mold during casting of steel in order to produce an improved free machining leaded steel.

In accordance with this invention, an exemplary steel alloy having improved machinability is prepared from a steel melt containing from about 0.01 to about 0.18 percent weight carbon and only minor impurities or other trace elements. The melt is deoxidized with about 1% by weight ferromanganese and after deoxidation, using either a continuous or conventional ingot mold, powdered lead sulfide (galena) is added in a proportion such that the lead comprises from about 0.15 to about 0.35 weight percent and the sulfur comprises from about 0.10 to about 0.40 weight percent of the melt. The typical trace elements or impurities usually present in such a melt are limited to trace quantities such as less than about 1.65 weight percent each with a combined total content thereof generally not exceeding 3.5 weight percent.

In another example by way of illustration, a 12L15 melt may be prepared in the manner hereinafter described. The desired 12L15 composition is generally about 0.09 weight percent carbon, from about 0.75 to about 1.05 weight percent manganese, from about 0.04 to about 0.09 weight percent phosphorous, from about 0.26 to about 0.35 weight percent sulfur, from about 0.15 to about 0.35 weight percent lead, and normal trace elements, the balance being iron.

To prepare a 10,000-pound melt of 12L15 steel having a 0.3 weight percent nominal lead composition, 30 pound of lead are required. Using powdered, essentially pure galena as the lead source, according to the formula $1/0.866 \times 30 = 34.642$ pounds of galena are required. Additionally, 34.642 pounds of galena provides about 4.642 pounds of sulfur which sulfur is contributed to the melt according to the formula 4.642 pounds/10,000 pounds $\times 100 = 0.0464$ weight percent sulfur in the 10,000-pound melt example. In this example, steels of the SAE 1000 series generally include about 0.05 weight percent sulfur; adding the approximately 0.0464 weight percent sulfur supplied by the galena addition, approximately 0.2 weight percent sulfur must be added to arrive at a nominal 0.3 weight percent sulfur composition. Such sulfur may be provided in the form of particulated iron pyrite ($FeS_2$) or other convenient material. It is to be noted that certain free machining steels are produced with sulfur contents as low as about 0.1 weight percent; this amount would be produced with galena additions only.

Oxygen control is important in steel production; in the example given above, the oxygen content of steel at the point of tapping is frequently within a range of from about 0.05 to about 0.1 weight percent. Sufficient ferromanganese should be added prior to casting to "tie up" the oxygen and form a slag. There should also be sufficient residual manganese available to facilitate formation of the manganese-sulfide particles. Manganese is the preferred de-oxidizer in leaded steels; aluminum is generally avoided as aluminum oxide particles would form and alumina particles are known to decrease tool life. Standard ferromanganese may ordinarily contain from about 74 to about 82 weight percent manganese, about 1.25 weight percent silicon, about 0.35 weight percent phosphorus, about 7.5 weight percent carbon, about 0.05 weight percent sulfur, only trace amounts of impurities, the remainder being iron. Low phosphorus, low carbon, and low silicon ferromanganese products are readily available; it is important to note that in order to produce an optimum free machining steel a low silicon ferromanganese product should be used.

Several methods of producing the improved alloy are contemplated in this invention, including conventional ingot casting, conventional reciprocating mold continuous casting, and continuous casting by apparatus wherein at least one of the mold surfaces is a continuous advancing mold wall which moves in conjugate relation with the solidifying metal. Three methods of injection of the powdered galena are contemplated, including simply sprinkling the powder on the melt in the mold (as was successfully done experimentally) injection into the tundish outflow into the mold (FIG. 1), or by injection at or below the molten metal surface, as may be preferred when continuous casting in a shrouded mold or mold area protected by an inert gas. It is contemplated that continuous cast products will show improved properties, while continuous cast products cast by the continuously advancing mold wall (such as wheel/band apparatus) method, especially when the metal is shrouded by a protective inert gas, should demonstrate superior distribution of small, spheroid manganese sulfide inclusions accompanied by excellent lead microsegregation. These qualities are improved by stirring, as by an electromagnetic or gas means known in the art.

In the case of conventional continuous steel casting, as shown schematically in the drawing FIGURE, one of many apparatus 10 capable of injecting powdered lead sulfide into the casting mold is shown. Means to powderize 11 the lead sulfide material (not shown) provides the powderized lead sulfide to feeding hopper 12 which feeds the powderized lead sulfide to a screw feeder 13 mechanism which in turn transports the powder to the discharge point at a rate proportional to the rotation of the screw feeder 13. Screw feeder 13 is driven by gear train 15 which in turn is driven by adjustable speed motor 14, the speed of which may be automatically or manually controlled as desired. Powdered lead sulfide arrives at mixer 16, wherein a pressurized gas (preferrably inert) from source 18 is mixed at a rate determined by valve 17 with the powdered lead sulfide and injecting via tube 19 into the molten metal stream 23 supplying molten metal to mold 20. The lead sulfide powder 22 is preferrably mixed directly with the flowing molten metal stream 23, through alternately the lead sulfide powder 22 may be introduced into the tundish 21, especially if stirring of the melt is effected, as by gas or electromagnetic stirring. The latter method may be useful where the molten metal is maintained within a closed system to prevent contamination or oxidation. Alternatively, the lead sulphide may be contained within a meltable skin intermediate product having, for example, but not limitation, and elongated rod-like configuration.

To prove the efficency of the present invention test samples were prepared under laboratory conditions. A more complete understanding of the invention will be obtained from the following example.

Exemplary test melts were produced under laboratory conditions to prove the product according to the present invention. The test melts produced were generally about three pounds in size.

Clay cup crucibles and a high frequency Lepel induction furnace were used to melt low carbon steels having from about 0.06 to about 0.15 weight percent carbon and impurities typical of SAE 1000 series steel, including from about 0.25 to about 1.5 weight percent manganese, about 0.04 weight percent phosphorus, and about 0.05 weight percent sulfur.

After melting, the steel temperature was raised to approximately 3200 degrees Fahrenheit; a sticky slag was noted to form on the surface of the melt; this reaction was assumed to be the result of an interaction between the melt and the crucible, with some of the slag being manganese oxide. Additional manganese, about 1.0 weight percent or approximately 13.6 grams, was added to compensate for the loss and to provide the necessary manganese needed to form the desired manganese sulfide particles. The manganese additions were made when the melt temperature was approximately 3000 degrees Fahrenheit, whereupon the melt was held at approximately 3000 degrees Fahrenheit for one minute.

The steel was then cast into another clay cup crucible while concurrently adding lead sulfide powder by sprinkling the powder uniformly into the melt. A total of approximately 14 grams, or about 1.02 weight percent lead sulfide was added in this manner, thus providing about 0.88 weight percent lead and about 0.14 weight percent additional sulfur. The small amount of extra lead was added to compensate for some small amount thereof lost due to vaporization and a small amount lost due to settling, which latter amount would be minimum in continuous casting operations. The total sulfur content was about 0.2 weight percent in this casting.

Several important notes were perceived as a result of the experimental castings. First, since some slight lead loss due to settling and vaporization was noted, and since sulfur is relatively easy to retain in solution, the resulfurizing effect provided by the lead sulfide, or galena, may provide somewhat more than the about 0.0464 weight percent figure derived by calculation since some additional lead sulfide is required to compensate for the lead losses. Secondly, the size of the lead globules can be somewhat controlled by the size of the lead sulfide (galena) powder. It is also noted that the powder additions can be greatly improved as to uniformity of addition as well as distribution if apparatus as described in FIG. 1 were used for the additions; such apparatus has been tested experimentally and operates effectively. Finally, it should be noted again that low silicon containing ferromanganese should be used as a de-oxidizer to limit undue oxidation of the manganese when making the addition thereof.

INDUSTRIAL APPLICABILITY

Improved machinability of steel includes: tool performance as represented by longer tool life under given conditions, improved speed at which material can be cut under different conditions while maintaining a given tool life, the force, energy, or power required is reduced, and improved surface finish and/or dimensional accuracy maintained among life pieces under given conditions. Ultimately, the final effect of improved machinability is economical metal shaping and metal removal.

I claim:

1. A method of producing leaded, resulfurized free machining steel comprising the steps of preparing a molten steel melt, deoxidizing said steel melt with from about 0.3 to about 1.65 percent by weight of manganese in the form of ferromanganese, introducing particulated lead sulfide into the molten steel, and cooling the molten steel to solidification in a mold.

2. A method of producing leaded, resulfurized free machining steel according to claim 1 wherein the particulated lead sulfide is powdered native galena having only trace amounts of impurities.

3. A method of producing leaded, resulfurized free machining steel according to claim 1 in which the particulated lead sulfide is introduced into the molten steel before the molten steel is introduced into a casting mold.

4. A method of producing leaded, resulfurized free machining steel according to claim 1 in which the particulated lead sulfide is introduced into the molten steel while the molten steel is being introduced into a casting mold.

5. A method of producing leaded, resulfurized free machining steel according to claim 1 in which the particulated lead sulfide is introduced into the molten steel after the molten steel has been introduced into the casting mold.

6. A method of producing leaded, resulfurized free machining steel according to claim 1 or 2 in which the particulated lead sulfide is contained within a rod-like intermediate product having a meltable covering.

7. A method of producing leaded, resulfurized free machining steel according to claim 1, 2, 3, 4, or 5 in which the mold is a bottomless continuous casting mold and further comprising the steps of reciprocating the mold, cooling said mold thereby causing said molten steel to solidify adjacent the mold walls to define a steel strand having a shell of solid metal about a molten core, continuously withdrawing said strand from the mold while molten metal is poured continuously into the mold, and said continuously withdrawn strand is cooled until solidification is effected.

8. A method of producing leaded, resulfurized free machining steel according to claim 1, 2, 3, 4, or 5 in which the mold is a continuously advancing mold formed by at least one endless moving surface in conjunction with other sealing surfaces so as to provide a closed mold having entry and exit ends and comprising the further steps of cooling said mold thereby causing said molten steel to solidify adjacent the mold walls to form a steel strand having a shell of solid metal about a molten core, advancing the mold and withdrawing the at least partially solidified strand from the exit end of the closed portion of the mold and cooling said at least partially solidified strand until solidification is effected.

9. A method of producing leaded, resulfurized free machining steel according to claim 1, 2, 3, 4, or 5 in which the powderized lead sulfide is mixed with a pressurized gas and injected into the molten steel.

10. A method of producing leaded, resulfurized free machining steel comprising the steps of preparing a molten steel melt, deoxidizing said steel melt with from about 0.3 to about 1.65 percent by weight of manganese in the form of ferromanganese, introducing particulated lead sulfide into the molten steel, and cooling the molten steel to solidification in a mold, further characterized in that the resultant lead globules are controlled as to size by the size of the lead sulfide powder granule size.

11. A leaded, resulfurized, manganese deoxidized free machining steel product comprising from about 0.03 to about 0.45 weight percent carbon, from about 0.3 to about 1.65 weight percent manganese, from about 0.04 to about 0.12 weight percent phosphorus, from about 0.05 to about 0.5 weight percent sulphur, from about 0.15 to about 0.35 weight percent lead and only trace quantities of impurities not exceeding about 3.5 weight percent, wherein the as-cast steel product is produced by the addition of particulated lead sulfide particles to said manganese deoxidized steel melt and said as-cast steel product includes well distributed manganese sulfide particles having an aspect ratio of less than 10 to 1.

12. A leaded, resulfurized free machining steel product according to claim 11 wherein the manganese sulfide particles have an aspect ratio of less than 5 to 1.

13. A leaded, resulfurized free machining steel product according to claim 11 wherein the manganese sulfide particles are essentially spheroidal.

14. A leaded, resulfurized free machining steel product according to claim 11 wherein the lead is well dispersed in the steel matrix and the free lead globules are small and well distributed.

15. A leaded, resulfurized free machining steel product according to claim 11, 12, 13, or 14 containing up to 0.05 weight percent zinc.

* * * * *